US006568016B1

(12) United States Patent
Hoogland

(10) Patent No.: US 6,568,016 B1
(45) Date of Patent: May 27, 2003

(54) FIREFIGHTER'S AXE

(75) Inventor: Chris Hoogland, 181 Stoneforrest Dr., Woodstock, GA (US) 30189

(73) Assignee: Chris Hoogland, Woodstock, GA (US)

( * ) Notice: Subject to any disclaimer, the term of this patent is extended or adjusted under 35 U.S.C. 154(b) by 0 days.

(21) Appl. No.: 09/626,652

(22) Filed: Jul. 27, 2000

(51) Int. Cl.[7] ..... B25D 1/04
(52) U.S. Cl. ..... 7/145; 7/166; 30/308.1
(58) Field of Search ..... 7/145, 166, 158, 7/161; 30/308.1, 308

(56) References Cited

U.S. PATENT DOCUMENTS 591,689 A * 10/1897 Ponkey ..... 7/145 X
604,830 A * 5/1898 Karner ..... 7/145
618,658 A * 1/1899 Garlick et al. ..... 7/145
1,596,602 A * 8/1926 Eagan et al. ..... 7/145
D163,911 S 7/1951 Sutter
D209,381 S 11/1967 Reuterfors et al.
5,315,724 A * 5/1994 Trujillo et al. ..... 7/145

* cited by examiner

*Primary Examiner*—D. S. Meislin
(74) *Attorney, Agent, or Firm*—Thomas, Kayden, Horstemeyer & Risley, LLP

(57) ABSTRACT

A firefighter's axe generally comprising a handle having a top end and a bottom end, a stem forming a portion of the elongated handle adjacent the top end of the handle, and a head having a front end and a rear end. Formed on the front end of the axe head is a blade. Formed on the rear end of the axe head is a sweeping surface that is substantially planar in shape. The axe head further includes a thumb opening with which the user can grip the axe head.

7 Claims, 3 Drawing Sheets

FIREFIGHTER'S AXE

FIELD OF THE INVENTION

The present disclosure relates to a firefighter's axe. More particularly, the present disclosure relates to a firefighter's axe that can be used to sweep floor surfaces when searching in low visibility environments.

BACKGROUND OF THE INVENTION

In search and rescue operations, firefighters are often required to enter burning buildings in search of fire victims. Firefighters usually carry forcible entry tools with them in such operations that they use to penetrate the various rooms of the buildings. Axes are particularly useful tools in these situations in that they can be used to break down locked doors, break through walls, and assist the firefighter in probing for obstacles and victims.

Visibility is often very limited in burning buildings due to the smoke created from the combustion of flammable materials. In that smoke, as well as heat, rises, firefighters commonly crawl on their hands and knees to limit their exposure to the smoke and heat and to increase their visibility. In advanced stages of a fire, however, visibility can be nearly zero even near the floor. Accordingly, firefighters are often called upon to "feel" their way around the building.

In one common practice, firefighters sweep the area around them with a standard axe. For instance, a firefighter may grasp his or her axe handle adjacent the axe head and sweep the area with the axe handle to locate the victims and/or obstacles that may be in the area. Unfortunately, sweeping an area in this manner can be difficult due to the design of conventional axes. First, crawling on the hands and knees while grasping the axe just below the axe head requires the firefighter to support his or her weight with his or her knuckles. This practice not only causes discomfort to the firefighter but also can hinder his or her performance in rescuing fire victims and/or fighting the fire.

To avoid "crawling" on the knuckles, a firefighter can alternatively grip the head of the axe while sweeping the handle back and forth. However, in that conventional axe heads are not designed for gripping, it can be difficult for the firefighter to obtain a secure grip on the axe. Moreover, in that many conventional axe heads are provided with a pick that protrudes rearwardly from the back end of the axe head, the firefighter may have to support the weight of the axe above the ground in that the pick prevents smooth sliding of the axe head along the floor surface. Clearly, this practice can increase firefighter fatigue and again hinder performance. Although other axes have flat butt ends, the widths of these ends are normally too narrow to facilitate easy sliding of the axe head on the floor surface.

From the above, it can be appreciated that it would be desirable to have an axe which can be securely grasped by the head and easily swept back and forth during search and rescue operations.

SUMMARY OF THE INVENTION

The present disclosure relates to a firefighter's axe. The axe generally comprises a handle having a top end and a bottom end, a stem forming a portion of the elongated handle adjacent the top end of the handle, and a head having a front end and a rear end. Formed on the front end of the axe head is a blade. Formed on the rear end of the axe head is a sweeping surface that is substantially planar in shape. The axe head further includes a thumb opening with which the user can grip the axe head.

In addition the present disclosure relates to a method for sweeping a floor surface, comprising grasping an axe head with one's thumb extending through a thumb opening formed of the axe head, resting the axe head on the floor surface on a broad sweeping surface formed on a rear end of the axe head, and sweeping a handle of the axe back and forth adjacent the floor surface.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
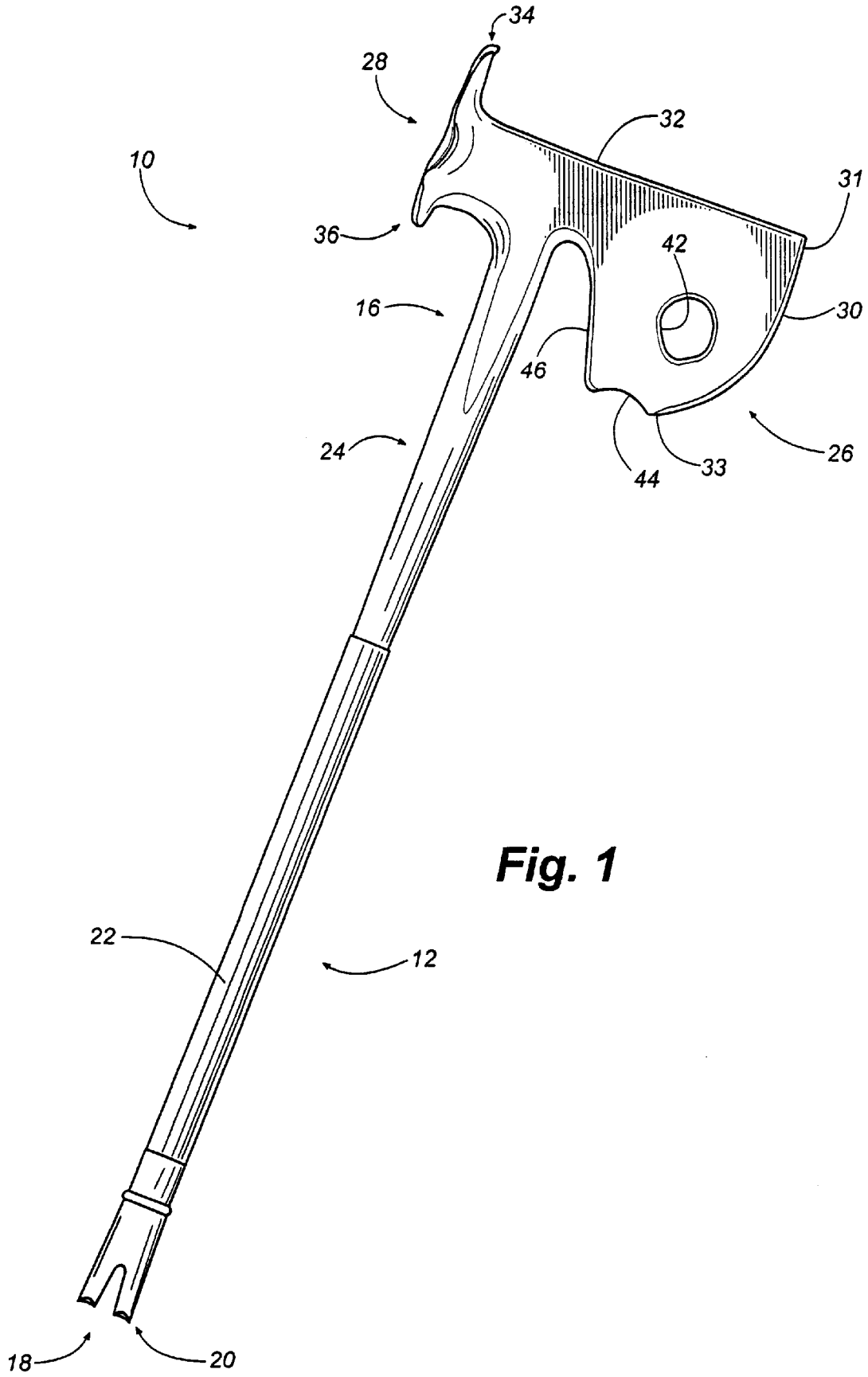
FIG. 1 is a side view of a firefighter's axe of the present invention.
Figure 2:
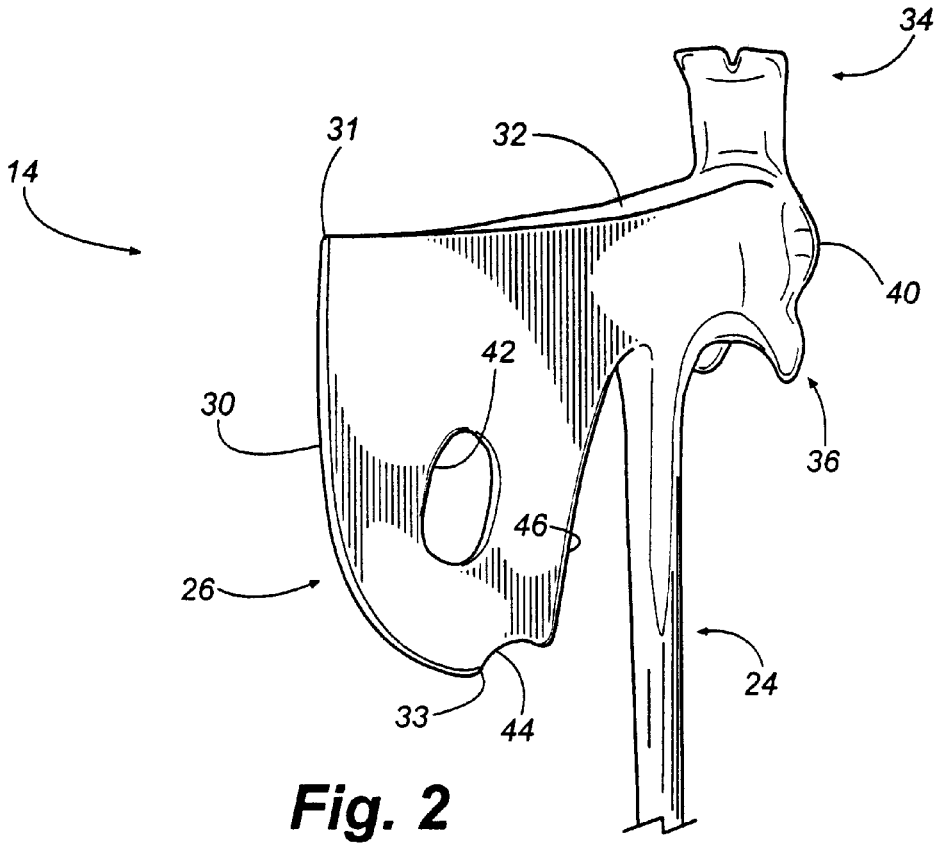
FIG. 2 is a front top perspective view of the axe head of the firefighter's axe shown in FIG. 1.
Figure 3:
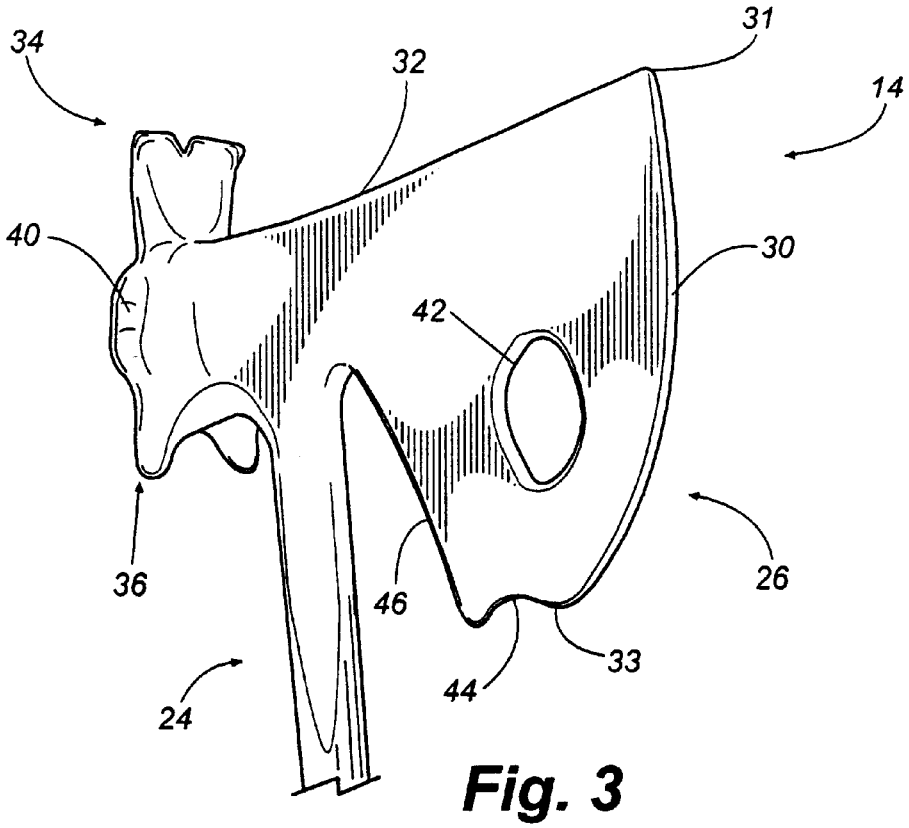
FIG. 3 is a front bottom perspective view of the axe head of the firefighter's axe shown in FIG. 1.

Referring now in more detail to the drawings, in which like numerals indicate corresponding parts throughout the several views, FIG. 1 illustrates a firefighter's axe 10 of the present invention. As indicated in this figure, the axe 10 generally comprises an axe handle 12 and an axe head 14. The axe handle 12 is typically elongated and includes a top end 16 and a bottom end 18. At the bottom end 18 is a first pry tool 20 which, by way of example, can be used to pry open doors and the like within a burning building. Adjacent the first pry tool 20 is a grip 22 with which the axe 10 can be gripped by the firefighter. Located intermediate the grip 22 and the axe head 14 is a stem 24 that, as shown in the drawing, can be unitarily formed with the axe head 14. Although capable of alternative construction, the axe handle 12, exclusive of the stem 24, normally is composed of a strong, lightweight material such as a fiberglass material.

The axe head 14 will now be discussed in detail with reference to FIGS. 1–4. The axe head 14 is composed of a strong and durable metal material such as a steel and/or titanium alloy. As indicated in the drawings, the axe head 14 generally comprises a front end 26 and a rear end or butt 28. Formed along the front end 26 of the axe head 14 is a blade 30 that has a top end 31 and a bottom end 33. Extending from the top end 31 of the blade 30 to the rear end 28 of the axe head 14 is top surface 32 that can be generally planar in shape. Formed at the rear end 28 of the axe head 14 can be one or more forcible entry tools. For instance, in the embodiment shown in the figures, the axe head 14 can be provided with a second pry tool 34 and a hook or claw tool 36. By way of example, the second pry tool 34 can extend upwardly from the top surface 32 of the axe head 14 while the hook tool 36 can extend downwardly from the second pry tool 34 toward the bottom end 18 of the handle 12.

Figure 4:
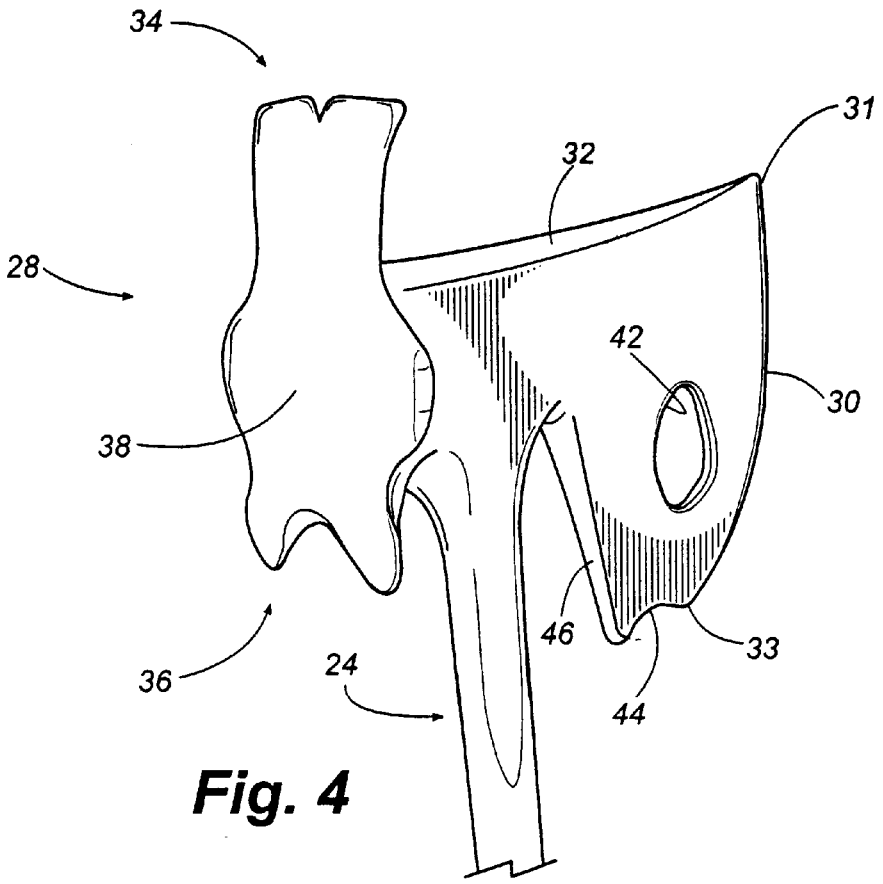
FIG. 4 is a rear perspective view of the axe head of the firefighter's axe shown in FIG. 1.

With reference to FIG. 4, the rear end 28 of the axe head 14 is preferably provided with a sweeping surface 38 with which the axe head 14 can be swept across a floor surface during search and rescue operations. As indicated in this Figure, this sweeping surface 38 is generally planar and circular in shape to provide a broad base upon which the axe head 14 can be swept across the floor. To avoid snagging of the axe head 14 while the axe 10 is being swept, the peripheral edges of the sweeping surface 38 preferably are curved upwardly (see FIG. 5) toward the front end 26 of the axe head. Accordingly, the second pry tool 34 and the hook tool 36 preferably curve in this direction as indicated in FIG. 1. Additionally, opposed sides 40 of the sweeping surface 38 also curve toward the front end 26 of the axe head 14. Due to its shape, the sweeping surface 38 can also be used as a hammer when such functionality is needed.

The axe head 14 is further provided with means for gripping the axe head. By way of example, these means can include a thumb opening 42, a finger notch 44, and a grip surface 46 as indicated in the figure. The thumb opening 42 can be generally circular and provided through the head adjacent the blade 30 while the finger notch 44 can be generally semi-circular in shape and provided adjacent the bottom end 33 of the blade. The grip surface 46 can be formed between the blade 30 and the stem 24 of the axe 10.

Figure 5:
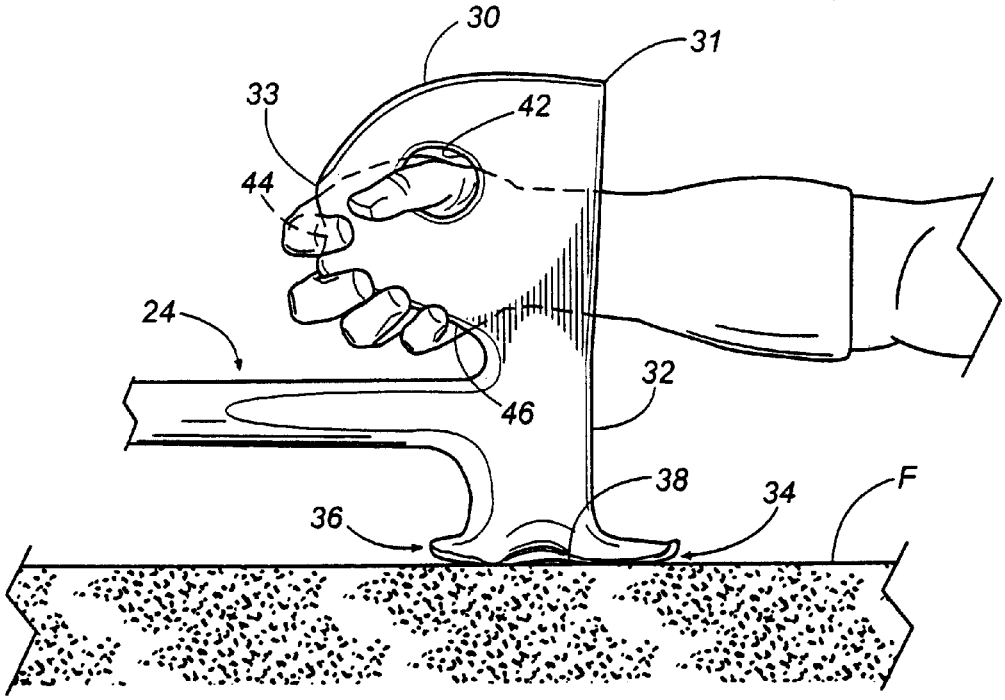
FIG. 5 is a partial side view of the firefighter's axe shown in FIG. 1, illustrating use of the axe during sweeping.

FIG. 5 illustrates the manner in which the axe head 14 is gripped when the axe 10 is used to sweep an area. As indicated in this Figure, the axe head 14 is placed on the floor F such that the sweeping surface 38 supports the weight of the axe head instead of the firefighter. The firefighter places his or her thumb through the thumb opening 42 and his or her index finger in the finger notch 44. When the firefighter's hand is placed around the axe head 14 in this manner, the remaining fingers of the hand can be wrapped around the grip surface 46 so that a firm grip upon the axe head can be obtained. Notably, the axe head 14 can be comfortably gripped equally well with the left or right hand such that the firefighter can switch hands when necessary, and such that right handed or left handed firefighters can use the axe 10. Once the axe 10 is gripped in the manner shown in FIG. 5, the firefighter can sweep the axe handle 12 forwardly or backwardly as well as side to side all with a high degree of control due to the sweeping surface 38. In that the firefighter is not supporting his or her weight with his or her knuckles, the discomfort normally associated with this sweeping action is avoided. Accordingly, the firefighter can quickly and easily locate fire victims and/or obstacles while crawling along the floor surface of the burning building.

While particular embodiments of the invention have been disclosed in detail in the foregoing description and drawings for purposes of example, it will be understood by those skilled in the art that variations and modifications thereof can be made without departing from the spirit and scope of the invention as set forth in the following claims.

What is claimed is:

1. A method for sweeping a floor surface, comprising:

grasping an axe head with one's thumb extending through a thumb opening formed in the axe head;

resting the axe head on the floor surface on a broad sweeping surface formed on a rear end of the axe head; and sweeping a handle of the axe back and forth adjacent the floor surface with the axe head.

2. The method of claim 1, wherein the thumb opening is substantially circular in shape.

3. The method of claim 1, wherein the axe head includes a finger notch formed adjacent a bottom end of a blade of the axe head.

4. The method of claim 3, wherein the finger notch is substantially semi-circular in shape.

5. The method of claim 1, wherein the axe head further includes a grip surface formed between a blade and a stem of the axe.

6. The method of claim 1, wherein the axe head includes at least one forcible entry tool formed at a rear end of the head.

7. The method of claim 1, wherein the broad sweeping surface is bordered by upwardly curved edges.

* * * * *